US005356143A

United States Patent [19]

Hylak

[11] Patent Number: 5,356,143

[45] Date of Patent: Oct. 18, 1994

[54] DEVICES FOR USE WITH AN AIR CUSHION GAME TABLE

[75] Inventor: Peter J. Hylak, Northbrook, Ill.

[73] Assignee: E & H Plastics, Inc., Chicago, Ill.

[21] Appl. No.: 100,045

[22] Filed: Jul. 30, 1993

[51] Int. Cl.[5] ..... A63F 7/00

[52] U.S. Cl. ..... 273/126 A; 273/126 R

[58] Field of Search ..... 273/126, 128; 251/300

[56] References Cited

U.S. PATENT DOCUMENTS

| | | | |
|---|---|---|---|
| 1,327,351 | 1/1920 | Norton | 251/300 |
| 3,066,937 | 12/1962 | Pflungmann . | |
| 3,367,658 | 2/1968 | Bayha . | |
| 3,722,888 | 3/1973 | Ducharme | 273/126 R |
| 3,773,325 | 11/1973 | Crossman et al. . | |
| 3,871,585 | 3/1975 | Crossman et al. | 273/126 A X |
| 3,887,187 | 6/1975 | Crossman et al. . | |
| 3,927,885 | 12/1975 | Crossman et al. | 273/126 R |
| 4,076,242 | 2/1978 | Joseph | 273/126 R X |
| 4,555,114 | 4/1985 | Dozier | 273/126 R X |

*Primary Examiner*—Vincent Millin
*Assistant Examiner*—Raleigh W. Chiu
*Attorney, Agent, or Firm*—Wallenstein, Wagner & Hattis, Ltd.

[57] ABSTRACT

The present invention relates generally to devices for use in connection with an air cushion game table. Specifically, the present invention is directed to a device for regulating the air flow onto a surface of an air cushion game table. The air flow regulating device comprises an operating lever, an attached plate, and a level indicator panel. The operating lever has a top portion, a middle portion and a bottom portion. The top portion is secured to an underside of the table via pivotably mounted fasteners. The bottom portion extends from the side of the table enabling the device to be manually operated. The plate is attached to the top portion and is of sufficient size and shape to cover an air flow opening formed on the underside of the table. The level indicator panel allows a player to select a particular level of play. The present invention is also directed to an improved game piece or puck designed for use on an air cushion game table. Preferably, the game piece is a three-dimensional solid figure having from four to sixteen sides, wherein the sides are of equal length. Both devices enable a player to play a faster, more challenging game.

19 Claims, 2 Drawing Sheets

DEVICES FOR USE WITH AN AIR CUSHION GAME TABLE

DESCRIPTION

Technical Field

The present invention relates generally to devices for use in connection with an air cushion game table, and to equipment for playing games on that table. Specifically, the present invention is directed to a device for varying the flow of air onto a perforated surface of an air cushion game table, and is also directed to an improved game piece or puck designed for use in playing games on the surface of an air cushion game table.

BACKGROUND OF THE INVENTION

The invention is directed to the field of games and more specifically, is directed to devices for use in connection with games played upon an air cushion game table, such as the type of game table disclosed in U.S. Pat. No. 3,871,585 to Crossman et al. These game tables are of the type used to play the game popularly known as Air Hockey TM. The concept of using an air cushion game table having a near frictionaless surface to play a game in which game pieces float on air across the surface of the table is known in the prior art,and is also disclosed in U.S. Pat. Nos. 3,066,937 to Pslugmann, 3,367,658 to Bayha, 3,773,325 to Crossman et al., 3,887,187 to Crossman et al., and 3,927,885 to Crossman et al.

U.S. Pat. No. 3,871,585 to Crossman et al. discloses an air cushion table including an air bed or perforated surface to which air under pressure is supplied by an air supply system from below the surface. This construction creates a multiplicity of closely-spaced air jets upon which a game puck or game piece "floates," i.e., does not touch the table surface. The game is played with a puck or game piece of a size and weight, such that the puck will float upon the air cushion table surface. The game is also played with a paddle or bat configured to slide upon the game table surface and suitable for engaging the puck and directing it to a goal.

The mode of play of the game, as disclosed in U.S. Pat. No.3,871,585, involves sliding a puck across a virtually friction-free surface of an air cushion game table to try to direct the puck to a goal. Players stand at opposite ends of the table and slide their bats across the playing surface and attempt to knock the puck into the opponent's goal. Each player attempts to score by sliding his or her bat into the puck so as to knock it either directly into the opponent's goal or bank it off of one of the stainless steel bumper strips into the opponent's goal. The puck moves very quickly when hit solidly. Unless intercepted by the opponent's bat, the puck may quickly return to the striking player's end of the table.

However, this patent as well as the other prior art patents have deficiencies. Although the basic air cushion game tables of the prior art have air supply systems beneath the playing surface, none of the known prior art discloses a device for manually regulating the amount of air supplied to the grid of tiny air holes on the surface of the air cushion game table. In addition, although the game pieces or pucks of the prior art are suitable for floating movement upon air cushion game tables, the configurations of the prior art pucks are all disc-shaped or triangular, rather than multiple-sided.

The concepts of a device to vary the air flow volume onto the surface of an air cushion game table, and an improved, multiple-sided game piece or puck for use on an air cushion game table are novel. The means for regulating the flow of air onto the surface of an air cushion game table varies the amount of air supplied to the perforated surface of the table, and in turn, varies the speed at which a game piece or puck floats across the table surface when hit by a paddle or bat. Since the device of the present invention gives a player the ability to increase or decrease the amount of air supplied to the perforated surface of the table, the player may also vary the degree of difficulty and challenge of the game. Thus, the use of the air regulating device allows players at various levels of skill to play and enjoy the game. For example, beginning, intermediate and advanced players all have the opportunity to participate in the game, at air supply levels they may find most suitable. The device also enables players to improve their level of skill by advancing to a more difficult level of play, since the device can be manually adjusted to supply varying amounts of air to the perforated surface of the game table.

In addition, the use of a multiple-sided, angular game piece or puck, as disclosed by the present invention, provides an additional challenge to the game. For example, the disc-shaped puck disclosed in U.S. Pat. No. 3,927,885, is limited in the amount of speed and spin that may be imparted when the puck is hit by a game paddle or bat. However, the multiple-sided, angular shape of the game piece or puck of the present invention gives the puck increased speed, motion, and spin when propelled across the game table by a paddle or bat.

Thus, there is a need for devices to be used in playing games on an air cushion game table that enable players of various levels of skill to play the game. In addition, there is a need for devices to be used with an air cushion game table, where such devices impart an increased challenge and intensity to the game. Both the air flow regulating device and improved game piece or puck of the present invention satisfy these needs.

The present invention overcomes the deficiencies associated with the prior art by providing a means for varying the flow of air onto the surface of an air cushioned game table and by providing an improved game piece or puck for use in playing games on an air cushioned game table.

SUMMARY OF THE INVENTION

The present invention is directed to a device that varies or regulates the flow of air onto a perforated surface of an air cushion game table, such as the type of game table disclosed in U.S. Pat. No. 3,871,585 to Crossman et al. The type of table shown in this patent is used to play the game popularly known as Air Hockey TM.

The air flow regulating device of the present invention comprises an operating lever having a top portion, a middle portion and a bottom portion, in which the operating lever is bent approximately in an "S" shape. The top portion of the lever is secured to an underside of a standard air cushion game table and is not visible to players standing beside the lever at the side of the table. The bottom portion of the lever extends outwardly away from the attached underside portion and away from the side of the table, so that it is visible to players standing beside the lever at the side of the table. The bottom portion of the lever has a knob attached to its end, to assist in grasping the lever for manual operation of the device.

The air flow regulating device also comprises a substantially planar plate or baffle attached to the top portion of the operating lever. The plate is of sufficient size and shape to enable it to cover an air flow opening formed on the underside of the plenum or air chamber of an air cushion game table. The plenum supplies air to the perforated surface of the table via an air duct system. A fan situated along the underside of the table provides air to the plenum. The air flow regulating device also comprises a pivotably mounted fastening means, such as a pin, which is attached to an end portion of the top lever portion. The fastening means secures the top portion of the lever to the underside of the plenum of the air cushion game table, and enables the lever to be moved pivotally in either a right or left direction. In this specification, the term "secured to the underside of the table" can mean one of at least two things. First, the term can mean that the lever may be secured to the plenum box. Second, the term can mean the lever is secured to the underside of the perforated surface of the table.

Attached to the side of the table and positioned above the bottom portion of the operating lever is a level indicator panel. The panel indicates the various levels of play that a player may select. When the lever is moved to a right-most position, the plate attached to the lever completely covers the air flow opening, and a maximum amount of air is supplied to the surface of the table. In its right-most position, the lever is directly below the portion of the panel corresponding to the "Hotshot" designation.

When the lever is moved to an intermediate position, the plate attached to the lever partially covers the air flow opening, and a decreased amount of air is supplied to the surface of the table. The lever at the intermediate position is positioned below the "Expert" designation on the panel.

Finally, when the lever is moved to a left-most position, no portion of the plate attached to the lever covers the air flow opening, and a minimum amount of air is supplied to the surface of the table. The lever at the left-most position is positioned below the "Amateur" designation on the panel.

An aspect of the present invention provides that by using a device that varies the flow of air to the surface of an air cushion game table, players with differing levels of skill can all play the game. In addition, the device allows the levels of difficulty to be changed, so that a greater challenge may be presented to the player, while still maintaining the enjoyment of the game.

The present invention is also directed to an improved game piece or puck designed for use on an air cushion game table. Preferably, the game piece or puck is solid and has a substantially smooth, planar top surface and a substantially smooth, planar bottom surface. The game piece or puck also has a plurality of side portions, preferably being of equal length and equal width, that surround and enclose the top and bottom surfaces of the puck. Adjacent side portions form angles of equal measure, so as to give the puck a regular, geometrically-shaped form. The puck may have from about four sides of equal length to about sixteen sides of equal length. Preferably, the puck has eight sides of equal length, so that it is in the form of an octagon. The game piece or puck is of suitable size and weight, so that it is capable of floating upon the surface of the air cushion game table.

An aspect of the invention provides that the multiple-sided, angular shape of the game piece or puck enables the puck to have greater speed, motion, and spin, when it is hit by a game paddle or bat across the frictionless surface of the air cushion game table. Thus, a player using the improved angular game piece or puck can play a faster, more challenging game on the present air cushion game table.

Other advantages and aspects of the present invention will become apparent upon reading the following description of the drawings and the detailed description of the invention and preferred embodiment of the invention.

BRIEF DESCRIPTION OF THE DRAWINGS

FIG. I is a perspective view of the air flow regulating device of the present invention extending from the side of a standard air cushion game table.

DETAILED DESCRIPTION OF THE INVENTION

This invention is susceptible of embodiment in many different forms. The drawings and description show preferred embodiments of the invention. The present disclosure is to be considered as an example of the principles of the invention. The disclosure is not intended to limit the broad aspect of the invention to illustrated embodiments.

Figure 1:
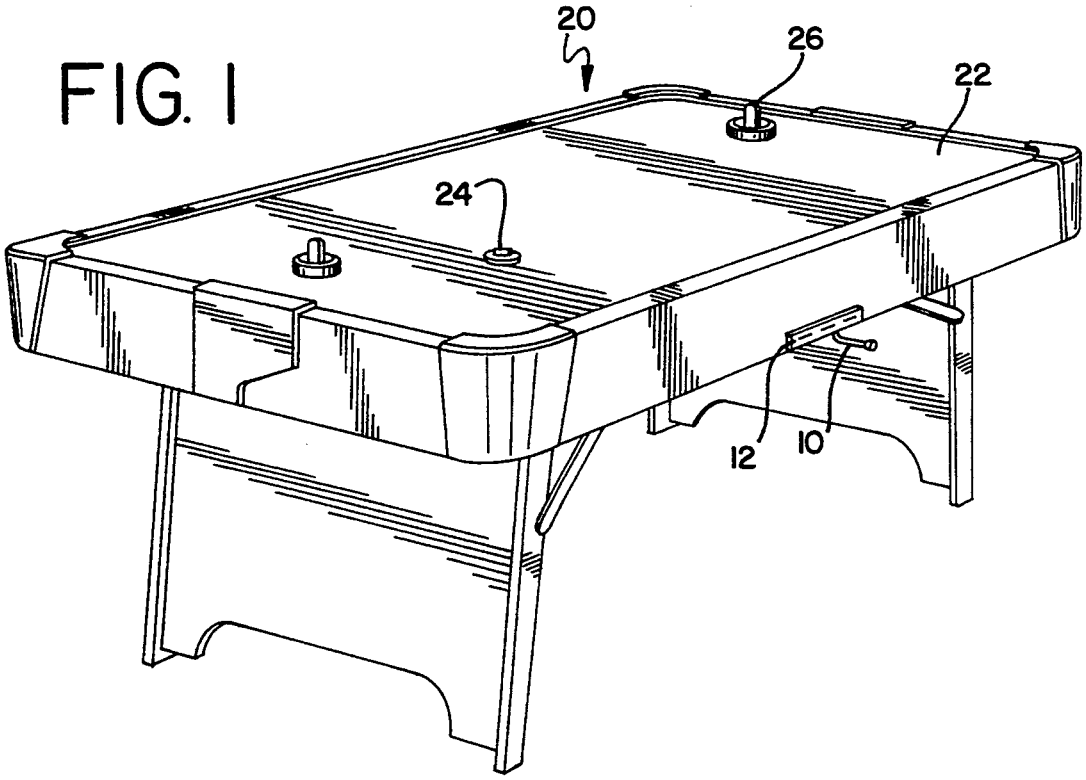

FIG. 1 shows the air flow regulating device 10 of the present invention. Portions of this device 10 partially extend from the side of a standard air cushion game table 20, such as the type of game table disclosed in U.S. Pat. No. 3,871,585 to Crossman et al. These game tables are used to play the game popularly known as Air Hockey TM. Standard game equipment, shown on the surface 22 of the table, includes a puck 24 and a pair of paddles or bats 26.

Although not shown in detail in the Figures of the present application, the construction of the air cushion bed of the game table 20 essentially includes air holes covering the playing surface of the table, a core having air channels and ducts communicating with and beneath the air holes, a phenolic panel having apertures below the core, and a plenum chamber below the phenolic panel which is supplied with air by a fan mounted below the plenum chamber.

Figure 2:
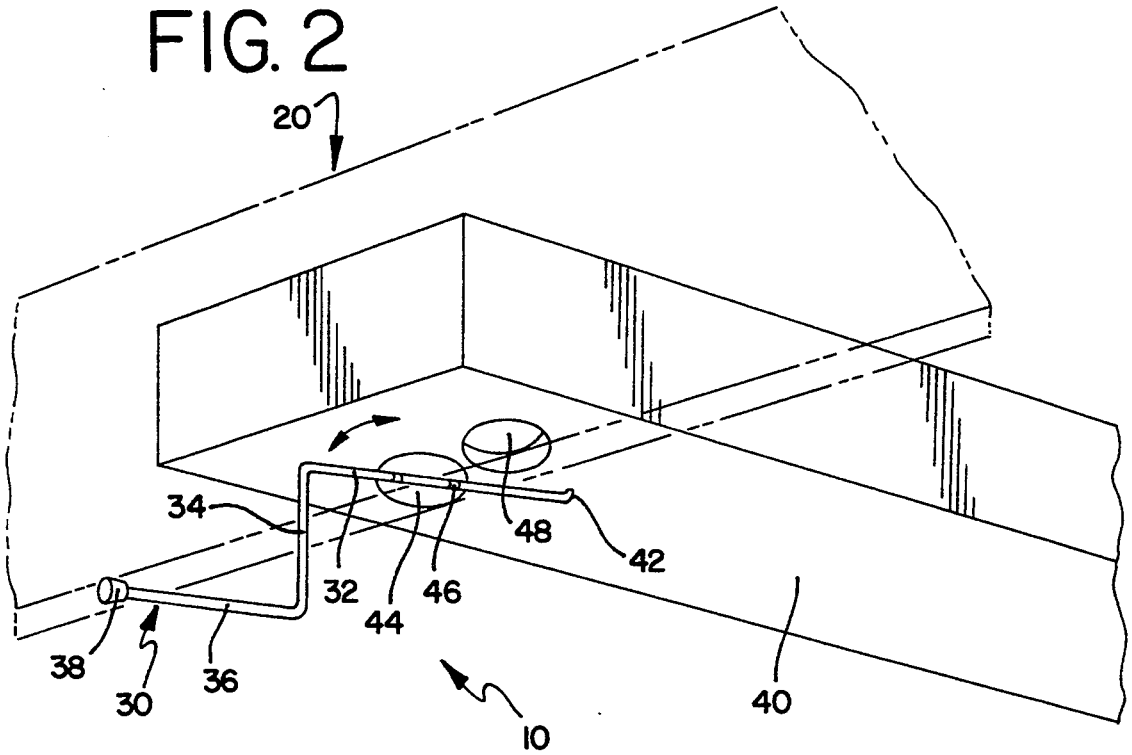
FIG. 2 is a bottom perspective view of the air flow regulating device of FIG. 1, illustrating the plenum, orifice, operating lever, and attached plate in the "Amateur" position.

FIG. 2 is an enlarged bottom perspective view of portions of the air flow regulating device 10. The device 10 comprises a pivotably mounted operating lever 30 having a top portion 32, a middle portion 34 and a bottom portion 36. The lever 30 is bent approximately in an "S" shape, and the middle portion 34 forms a right angle with and descends downwardly from the top portion 32. The top portion 32 and middle portion 34 are not visible by players standing near the device 10 at the side of the table 20. The bottom portion 36 forms a right angle with the middle portion 34 and extends outwardly away from the middle portion 34 and away from an underside 40 of the table 20. The bottom portion 36 is visible by players standing near the device 10 at the side of the table 20. The lever 30 has a knob 38 attached to the end of the bottom portion 36 of the lever 30, so that the lever 30 can be easily grasped for manual operation of the device 10. The top portion 32 of the lever 30 is secured to the underside portion 40 of table 20 via a pivotable fastening means, such as a pin 42. The pin 42, which serves as a pivotable fastening means, enables the lever 30 to move in a right and left pivotal direction, as shown by the arrows in FIG. 2.

The operating lever 30 is preferably made of a metal, such as steel.

The device 10 also comprises a substantially planar and circular plate or baffle 44 which is attached to the top portion 32 of the operating lever 30. Preferably, the plate 44 is made of sheet metal, and is approximately four (4) inches in diameter. The plate 44 is positioned such that it is between the underside 40 of the table 20 and the top portion 32 of lever 30. The plate 44 is fixedly attached to the top portion 32 via attachment means 46, such as metal clips. The plate 44 is of sufficient size and shape to cover an orifice or air flow opening 48 formed on the underside 40 of the table 20. Specifically, the air flow opening 48 is formed in the underside of the plenum chamber. Preferably, the opening 48 is approximately two (2) inches in diameter. When this opening 48 is uncovered by plate 44, part of the air provided to the plenum chamber by the fan is not supplied to the table surface 22, but rather flows through opening 48 and into the atmosphere.

Figure 2A:
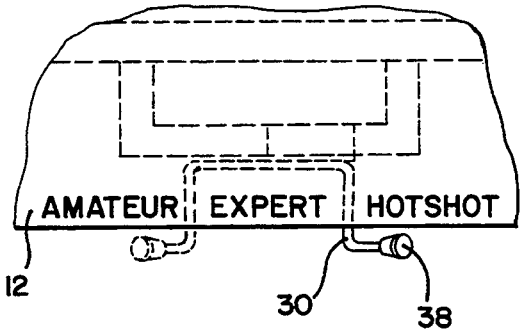
FIG. 2*a* is an enlarged perspective view of a portion of the air flow regulating device of FIG. 1, including the level indicator panel, with parts shown in section.

FIG. 2*a* is a front view of a portion of the air flow regulating device 10 of the present invention, and shows an enlarged view of the level indicator panel 12 of FIG. 1. When the lever 30 is moved to a left-most position, the air flow opening 48 is uncovered, and the lever is positioned at the "Amateur" level, as indicated on panel 12. When the lever 30 is moved to an intermediate position, a part of the air flow opening 48 is covered, and the lever is positioned at the "Expert" level. When the level 30 is moved to a right-most position, the entire air flow opening 48 is covered, and the lever is positioned at the "Hotshot" level.

Figure 3:
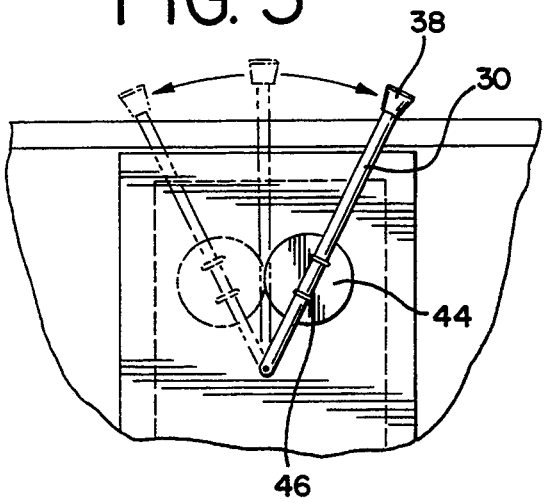
FIG. 3 is a bottom view of the air flow regulating device of FIG. 2, illustrating the plenum, orifice, operating lever and attached plate in the "Hotshot" position, and, in dotted lines, in two other different positions of use.

FIG. 3 is a bottom view of the air flow regulating device 10 showing the operating lever 30 and plate 44 in three different positions of play. When the operating lever 30 is moved to a left-most position, the plate 44 attached to the lever 30 covers no part of the air flow opening 48 and only a minimal amount of air is supplied to the table surface. The operating lever 30 in this left-most position is indicated on the operating panel as the "Amateur" level. Since a minimal amount of air is supplied to the table surface when the operating lever 30 is at the "Amateur" position, the speed of the puck, when hit or propelled by a paddle or bat, is less than its speed under conditions where more is supplied to the table surface.

When the lever 30 is moved to an intermediate position equidistant from the left-most and the right-most positions, the plate 44 covers approximately half of the air flow opening. The operating lever 30 in this intermediate position is designated on the operating panel 12 as the "Expert" level. A greater amount of air is supplied to the table surface when the operating lever 30 is at the "Expert" position than when the opening level 30 is at the "Amateur" level. As a result, the speed of the puck, when hit or propelled by a paddle or bat, is also greater. It will be appreciated that there are varying positions of intermediate play that can be selected, and that one preferably position is shown in FIG. 3.

Finally, when the lever 30 is moved to a right-most position, the plate 44 attached to the lever 30 completely covers the air flow opening, and a maximum amount of air is supplied to the table surface. The operating lever 30 in this position is indicated on the operating panel 12 as the "Hotshot" level. When the maximum amount of air is supplied to the table surface when the operating lever 30 is at the "Hotshot" position, puck/table friction is minimized. As a result, the speed of the puck, when hit or propelled by a paddle or bat with a given force, is at its greatest.

Figure 4:
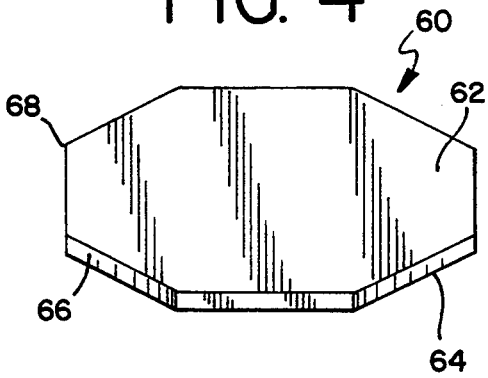
FIG. 4 is a perspective view of an embodiment of the puck of the present invention.
Figure 5:
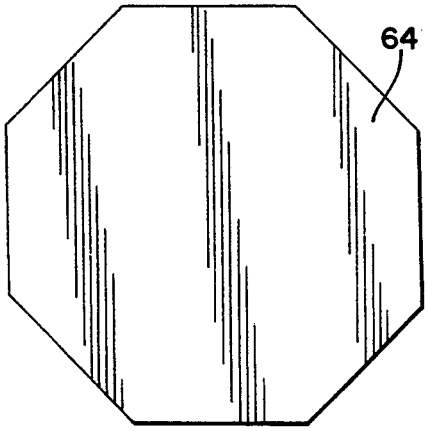
FIG. 5 is a bottom view of the puck of FIG. 4.
Figure 6:
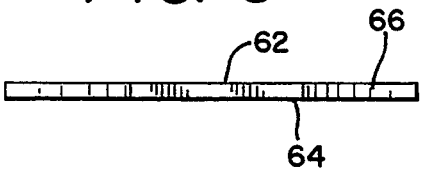
FIG. 6 is a side view of the puck of FIG. 4.

FIG. 4 is a perspective view of the preferred embodiment of an improved game piece or puck 60 of the present invention for use on an air cushion game table. The game piece or puck 650 is solid and comprises a substantially smooth, planar top surface 62 and a similar substantially smooth, planar bottom surface 64. The smooth surfaces 62, 64 enable the puck 60 to float easily across the surface 22 of table 20 shown in FIG. 1. The game piece or puck 60 has a plurality of side portions 66. These side portions 66 are preferably of equal length, so that an eight-sided piece will be a conventional octagon. Adjacent side portions 66 form angles 68 of equal measure.

The game piece or puck 60 may have from about four side portions 66 of equal length to about sixteen side portions 66 of equal length. Preferably, the puck 60 has eight side portions 66 and is in the shape of a rectangular octagon.

The game piece or puck 60 is of suitable size and weight so that it will float upon the surface of the air cushion game table. In the preferred embodiment shown in FIG. 4, the length of each side portion is approximately 1 inch, the width of the puck is approximately $\frac{1}{8}$ inch, and the effective length across the puck, from one tip to an opposite tip, is approximately $2\frac{5}{8}$ inches. The game piece or puck is preferably made of a high-density, lightweight plastic material, such as Lexan®, a product of General Electric which is a polycarbonate resin having a specific gravity, solid, of 1.20 as measured in accordance with ASTM D 792. It will be appreciated that the length of the side portions 66 and overall tip-to-tip distance across the game piece or puck 60 varies with the number of sides present.

The invention has been described with reference to preferred embodiments. However, it will be understood by those skilled in the art that various changes may be made and equivalents may be substituted for elements of the preferred embodiment without departing from the broader aspects of the invention.

I claim:

1. A device for varying the flow of air onto a surface of an air cushion game table comprising:

an air cushion game table having an underside, a topside, and first and second sides;

a pivotably mounted operating lever to be secured to said underside of said table and to extend from said first or second side of said table, said lever having an attached plate to cover an air flow opening formed on said underside of said table surface.

2. The device of claim 1 wherein said plate is substantially planar and circular and is to be positioned between said lever and said underside of said table.

3. The device of claim 1 wherein said operating lever has a top portion, a middle portion and a bottom portion, said lever being bent approximately in an "S" shape, said top portion to be secured to said underside of said table via a pivotably mounted fastening means, said middle portion forming a right angle with said top portion and descending downwardly therefrom, and said bottom portion forming a right angle with said middle portion and extending outwardly away from said middle portion to extend and away from said underside of said table, whereby said bottom portion is grasped for manual operation of said device.

4. The device of claim 1 wherein said operating lever is used with a level indicator panel attached to said side of said table and positioned above said lever.

5. The device of claim 1 wherein said plate attached to said lever does not cover said air flow opening when said lever is at a left-most position, wherein said plate attached to said lever partially covers said air flow opening when said lever is at an intermediate position, and wherein said plate attached to said lever completely covers said air flow opening when said lever is at a right-most position.

6. A device for varying or regulating the flow of air onto a surface of an air cushion game table comprising:

an air cushion game table having an underside, a topside, and first and second sides;

an operating lever to be secured to said underside by a pivotably mounted fastening means; and, a substantially planar, circular plate attached to said operating lever, said plate to cover an air flow opening formed on said underside; and, wherein when said lever is moved to a left-most position, said plate attached to said lever does not cover said air flow opening, and when said lever is moved to an intermediate position, said plate attached to said lever partially covers said air flow opening, and when said lever is moved to a right-most position, said plate attached to said lever completely covers said air flow opening.

7. The device of claim 6 wherein said operating lever has a top portion, a middle portion and a bottom portion, said lever being bent approximately in an "S" shape, said top portion to be secured to said underside of said table via said pivotably mounted fastening means, said middle portion forming a right angle with said top portion and descending downwardly therefrom, and said bottom portion forming a right angle with said middle portion and extending outwardly away from said middle portion and to extend away from said underside of said table, whereby said bottom portion is grasped for manual operation of said device.

8. The device of claim 6 wherein said operating lever is used with a level indicator panel attached to said side of said table and positioned above said lever.

9. A device for varying the flow of air onto a surface of an air cushion game table comprising:

an air cushion game table having an underside, a topside, and first and second sides;

an operating lever having a top portion, a middle portion, and a bottom portion, said lever being bent approximately in an "S" shape, said top portion to be secured to said underside, and said bottom portion to extend outwardly away from said underside, whereby said bottom portion is grasped for manual operation of said device;

a substantially planar plate attached to said top portion of said operating lever, said plate to cover an air flow opening formed on said underside; and, a pivotable mounted fastening means attached to an end of said top portion, said fastening means to secure said top portion to said underside allowing said lever to be moved pivotally, such that when said lever is moved to a left-most position, said plate attached to said lever completely uncovers said air flow opening; and such that when said lever is moved to an intermediate position, said plate attached to said lever partially covers said air flow opening, and such that when said lever is moved to a right-most position, said plate attached to said lever completely covers said air flow opening.

10. The device of claim 9 wherein said operating lever is used with a level indicator panel attached to said side of said table and positioned above said bottom portion of said lever.

11. An air cushion game comprising:

a game piece which is three-dimensional and constructed in the form of a one-piece, solid, uniform, plastic figure having top and bottom surfaces and from four side portions to sixteen side portions;

an air cushion game table having an underside, a topside, and first and second sides wherein said underside has an air flow opening;

an operating lever secured to said underside by a pivotable mounted fastening means; and, a substantially planar, circular plate attached to said operating lever wherein said plate adjustably covers said air flow opening.

12. The air cushion game of claim 11 wherein said top and bottom surfaces of said game piece are substantially smooth and planar enabling said game piece to float across said topside surface, and wherein said first and second side portions are of equal length.

13. The air cushion game of claim 11 wherein said game piece has eight side portions of equal length.

14. The air cushion game of claim 11 wherein said game piece is constructed of a polycarbonate resin having a specific gravity of approximately 1.2.

15. An air cushion game comprising:

an air cushion game table having a topside, an underside, an first and second sides, wherein said underside has an air flow opening;

an operating lever having first, second and third portions forming, approximately, an "S" shape, wherein said first portion is secured to said underside and said third position extends outward from said table, and wherein said third portion is capable of being grasped for manually operating said lever;

a substantially planar plate attached to said first portion and adjustable covering said air flow opening;

a pivotably mounted fastening means attaching said first portion to said underside wherein the flow of air through said air flow opening can be regulated by moving said lever so as to move said planar plate; and a one-piece, solid, uniform, polycarbonate puck having a specific gravity of approximately 1.2, wherein said puck has substantially smooth and planar top and bottom surfaces enabling said puck to float across said topside of said air cushion game table, and wherein said puck has a plurality of side portions equal length so as to give said puck a geometrically-shaped form.

16. The air cushion game of claim 15 wherein said puck has eight side portions.

17. The air cushion game of claim 15 wherein said puck has from four side portions to sixteen side portions.

18. The air cushion game of claim 15 wherein said puck is comprised of a polycarbonate plastic material having a specific gravity of approximately 1.20.

19. The air cushion game of claim 18 wherein said puck has eight side portions.

* * * * *

UNITED STATES PATENT AND TRADEMARK OFFICE

CERTIFICATE OF CORRECTION

PATENT NO. : 5,356,143

DATED : October 18, 1994

INVENTOR(S) : Peter J. Hylak

It is certified that error appears in the above-indentified patent and that said Letters Patent is hereby corrected as shown below:

Column 1, line 24, delete "frictionaless" and insert --frictionless--

Column 5, line 49, delete "level" and insert --lever--

Column 5, line 64, after "more" insert --air--

Column 6, line 5, delete "opening level" and insert --operating lever--

Column 6, line 10, delete "preferably" and insert --preferable--

Column 6, line 25, delete "650" and insert --60--

Column 6, line 38, delete "rectangular" and insert --regular--

Column 7, Claim 6, line 37 , delete "and,"

Column 8, Claim 9, line 7, delete "pivotable" and insert --pivotably--

Signed and Sealed this

Ninth Day of May, 1995

*Attest:*

Bruce Lehman

BRUCE LEHMAN

*Attesting Officer*

*Commissioner of Patents and Trademarks*